US010153063B2

(12) United States Patent
Ito et al.

(10) Patent No.: US 10,153,063 B2
(45) Date of Patent: Dec. 11, 2018

(54) COPPER ALLOY FOR ELECTRONIC DEVICES, METHOD OF MANUFACTURING COPPER ALLOY FOR ELECTRONIC DEVICES, COPPER ALLOY PLASTIC WORKING MATERIAL FOR ELECTRONIC DEVICES, AND COMPONENT FOR ELECTRONIC DEVICES

(71) Applicant: MITSUBISHI MATERIALS CORPORATION, Tokyo (JP)

(72) Inventors: Yuki Ito, Okegawa (JP); Kazunari Maki, Saitama (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

(21) Appl. No.: 14/352,184

(22) PCT Filed: Nov. 7, 2012

(86) PCT No.: PCT/JP2012/078851

§ 371 (c)(1),
(2) Date: Apr. 16, 2014

(87) PCT Pub. No.: WO2013/069687

PCT Pub. Date: May 16, 2013

(65) Prior Publication Data

US 2014/0283962 A1 Sep. 25, 2014

(30) Foreign Application Priority Data

Nov. 7, 2011 (JP) ..... 2011-243869

(51) Int. Cl.

| | |
|---|---|
| ***C22C 9/00*** | (2006.01) |
| ***H01B 1/02*** | (2006.01) |
| ***C22F 1/08*** | (2006.01) |

(52) U.S. Cl.
CPC ..... *H01B 1/026* (2013.01); *C22C 9/00* (2013.01); *C22F 1/08* (2013.01)

(58) Field of Classification Search
CPC ... C22F 1/00; C22F 1/002; C22F 1/08; H01B 1/026; C01P 2002/60
(Continued)

(56) References Cited

U.S. PATENT DOCUMENTS 4,337,793 A 7/1982 Sato et al.
4,732,731 A 3/1988 Asai et al.
(Continued)

FOREIGN PATENT DOCUMENTS

CN 101707084 A 5/2010
CN 102206766 A 10/2011
(Continued)

OTHER PUBLICATIONS

JP 11-199954 , computer-generated translation, original publication in Japanese on Jul. 27, 1999.*
(Continued)

*Primary Examiner* — Scott R Kastler
*Assistant Examiner* — Vanessa T. Luk
(74) *Attorney, Agent, or Firm* — Leason Ellis LLP

(57) ABSTRACT

A copper alloy for electronic devices has a low Young's modulus, high proof stress, high electrical conductivity and excellent bending formability and is appropriate for a component for electronic devices including a terminal, a connector, a relay and a lead frame. Also a method of manufacturing a copper alloy utilizes a copper alloy plastic working material for electronic devices, and a component for electronic devices. The copper alloy includes Mg at 3.3 to 6.9 at %, with a remainder substantially being Cu and unavoidable impurities. When a concentration of Mg is X at %, an electrical conductivity σ (% IACS) is in a range of
(Continued)

$\sigma \leq \{1.7241/(-0.0347 \times X^2 + 0.6569 \times X + 1.7)\} \times 100$, and an average grain size is in a range of 1 μm-100 μm. In addition, an average grain size of a copper material after an intermediate heat treatment and before finishing working is in a range of 1 μm-100 μm.

16 Claims, 2 Drawing Sheets

(58) Field of Classification Search
USPC ..... 420/494; 148/432–436
See application file for complete search history.

(56) References Cited

U.S. PATENT DOCUMENTS

| | | | |
|---|---|---|---|
| 2006/0239853 | A1 | 10/2006 | Maehara et al. |
| 2006/0275618 | A1 | 12/2006 | Kugimiya et al. |
| 2008/0298998 | A1 | 12/2008 | Kaneko |
| 2012/0267013 | A1 | 10/2012 | Kaneko et al. |
| 2013/0048162 | A1 | 2/2013 | Ito |
| 2014/0283961 | A1 | 9/2014 | Maki |
| 2014/0283962 | A1 | 9/2014 | Ito |
| 2014/0290805 | A1 | 10/2014 | Maki |
| 2016/0160321 | A1 | 6/2016 | Ito |

FOREIGN PATENT DOCUMENTS

| | | | |
|---|---|---|---|
| CN | 102822363 | A | 12/2012 |
| CN | 103842551 | A | 6/2014 |
| DE | 3628783 | A | 10/1987 |
| EP | 2319947 | A | 5/2011 |
| JP | 53-125222 | A | 11/1978 |
| JP | 62-250136 | A | 10/1987 |
| JP | 63-310929 | A | 12/1988 |
| JP | 64-052034 | A | 2/1989 |
| JP | 01-107943 | A | 4/1989 |
| JP | 01-309219 | A | 12/1989 |
| JP | 02-111834 | A | 4/1990 |
| JP | 02-145737 | A | 6/1990 |
| JP | 03-080858 | B | 12/1991 |
| JP | 04-268033 | A | 9/1992 |
| JP | 05-082203 | A | 4/1993 |
| JP | 07-018354 | A | 1/1995 |
| JP | 07-019788 | A | 1/1995 |
| JP | 07-166271 | A | 6/1995 |
| JP | 10-219372 | A | 8/1998 |
| JP | 11-036055 | A | 2/1999 |
| JP | 11-186273 | A | 7/1999 |
| JP | 11-199954 | A | 7/1999 |
| JP | 2001-152303 | A | 6/2001 |
| JP | 2011-241412 | A | 12/2001 |
| JP | 2002-180165 | A | 6/2002 |
| JP | 2005-113259 | A | 4/2005 |
| JP | 2010-053445 | A | 3/2010 |
| JP | 2010-188362 | A | 9/2010 |
| JP | 2011-102416 | A | 5/2011 |
| JP | 2012-251226 | A | 12/2012 |
| JP | 2013-100571 | A | 5/2013 |
| JP | 2013-104095 | A | 5/2013 |
| KR | 10-2014-0048335 | A | 4/2014 |
| WO | WO-2006/000307 | A | 1/2006 |
| WO | WO-2011/068135 | A | 6/2011 |
| WO | WO-2011/104982 | A | 9/2011 |

OTHER PUBLICATIONS

AMPCOLOY 90—Corrosion-Resistant High-Conductivity Casting Copper, Alloy Digest, Mar. 1981.*
Computer-Generated Translation of JP 2005-113259 (Maehara et al.), originally published in Japanese on Apr. 28, 2005.*
Thomson Reuters abstract of JP 07-018354 (Hashizume et al.), originally published in Japanese on Jan. 20, 1995.*
G.T. Murray and T.A. Lograsso, "Preparation and Characterization of Pure Metals," Properties and Selection: Nonferrous Alloys and Special-Purpose Materials, vol. 2, ASM Handbook, ASM International, 1990, pp. 1093-1097 (print), 13 pages total (online).*
Office Action dated Sep. 24, 2014 for the related U.S. Appl. No. 14/349,937.
Office Action dated Nov. 4, 2014 for the related U.S. Appl. No. 14/353,924.
European Search Report dated Jun. 6, 2014 for the related European Application No. 11780706.5.
Koya Nomura, "Technical Trends in High Performance Copper Alloy Strip for Connector and Kobe Steel's Development Strategy", *Kobe Steel Engineering Reports*, vol. 54. No. 1, 2004, pp. 2-8.
Shigenori Hori et al., "Grain Boundary Precipitation in Cu—Mg alloy", *Journal of the Japan Copper and Brass Research Association*, vol. 19,1980, pp. 115-124.
International Search Report dated Feb. 12, 2013 for the corresponding PCT Application No. PCT/JP2012/078851.
International Search Report dated Aug. 16, 2011 for the related PCT Application No. PCT/JP2011/061036.
International Search Report dated Jan. 29, 2013 for the related PCT Application No. PCT/JP2012/077736.
International Search Report dated Feb. 12, 2013 for the related PCT Application No. PCT/JP2012/078688.
Office Action dated Feb. 14, 2012 for the corresponding Japanese Application No. 2010-112265.
Office Action dated Nov. 29, 2013 for the corresponding Singaporean Application No. 201207897-8.
Office Action dated Dec. 4, 2013 for the corresponding Chinese Application No. 201180018491.7.
ASM International Handbook Committee. (1990). ASM Handbook, vol. 02—Properties and Selection: Nonferrous Alloys and Special-Purpose Materials-9. Introduction to Copper and Copper Alloys. ASM International. Online version available at: http://app.knovel.com/hotlink/pdf/id:kt007OVW5L/asm-handbook-volume-02/introduction-copper-copper, pp. 216-233.
Office Action dated Jan. 12, 2015 for the related U.S. Appl. No. 14/349,937.
Office Action dated Apr. 3, 2015 for the related Chinese Application No. 201280047170.4.
European Search Report dated Apr. 16, 2015 for the related EP Application No. 12843355.4.
Office Action dated Apr. 16, 2015 for the corresponding Chinese Application No. 201280047171.9.
European Search Report dated Apr. 16, 2015 for the related EP Application No. 12849153.7.
European Search Report dated Jun. 5, 2015 for the corresponding European Application No. 12847293.3.
Office Action dated Aug. 18, 2015 for the related Japanese Application No. 2011-248731.
Office Action dated Jan. 14, 2016 for the related Taiwanese Patent Application No. 101139714.
Office Action dated Jan. 14, 2016 for the corresponding Taiwanese Patent Application No. 101141343.
Notice of Allowance dated Oct. 29, 2015 for the related Chinese Application No. 201280049749.4.
Office Action dated Mar. 7, 2017 for the related U.S. Appl. No. 14/291,335.
Office Action dated Mar. 8, 2017 for the related U.S. Appl. No. 13/695,666.
*ASM Speciality Handbook-Copper and its alloys*, ISBN: 0-87170-726-8, Aug. 2001, pp. 15.
E.G. West, *Copper and its alloys*, ISBN: 0-85312-505-8, 1982, pp. 129.
Summons to attend oral proceedings mailed Nov. 4, 2016 for the related European Patent Application No. 12843355.4.
Summons to attend oral proceedings mailed Nov. 4, 2016 for the related European Patent Application No. 12849153.7.

(56) References Cited

OTHER PUBLICATIONS

Notice of Allowance dated Feb. 22, 2017 for the related Korean Patent Application No. 10-2014-7009375.
Office Action dated May 15, 2018 for the related U.S. Appl. No. 14/353,924.

* cited by examiner

COPPER ALLOY FOR ELECTRONIC DEVICES, METHOD OF MANUFACTURING COPPER ALLOY FOR ELECTRONIC DEVICES, COPPER ALLOY PLASTIC WORKING MATERIAL FOR ELECTRONIC DEVICES, AND COMPONENT FOR ELECTRONIC DEVICES

CROSS-REFERENCE TO RELATED PATENT APPLICATIONS

This application is a U.S. National Phase application under 35 U.S.C. § 371 of International Patent Application No PCT/JP2012/078851, filed Nov. 7, 2012, and claims the benefit of Japanese Patent Application No. 2011-243869, filed on Nov. 7, 2011, all of which are incorporated by reference in their entirety herein. The International Application was published in Japanese on May 16, 2013 as International Publication No. WO/2013/069687 under PCT Article 21(2).

FIELD OF THE INVENTION

The present invention relates to a copper alloy for electronic devices which is appropriate for a component for electronic devices such as a terminal including a connector, a relay, and a lead frame, a method of manufacturing a copper alloy for electronic devices, a copper alloy plastic working material for electronic devices, and a component for electronic devices.

BACKGROUND OF THE INVENTION

In the related art, due to a reduction in the size of an electronic device or electric device, reductions in the size and the thickness of a component for electronic devices such as a terminal including a connector, a relay, and a lead frame used in the electronic device, the electric device, or the like have been achieved. Therefore, as a material of the component for electronic devices, a copper alloy having excellent spring property, strength, and electrical conductivity has been required. Particularly, as disclosed in Non-Patent Document 1, it is desirable that the copper alloy used in the component for electronic devices such as a terminal including a connector, a relay, and a lead frame has high proof stress and low Young's modulus.

As the copper alloy having excellent spring property, strength, and electrical conductivity, for example, a Cu—Ni—Si-based alloy (so-called Corson alloy) is provided in Patent Document 1. The Corson alloy is a precipitation hardening type alloy in which $Ni_2Si$ precipitates are dispersed, and has relatively high electrical conductivity, strength, and stress relaxation resistance. Therefore, the Corson alloy has been widely used in a terminal for a vehicle and a small terminal for signal, and has been actively developed in recent years.

In addition, as the other alloys, a Cu—Mg alloy described in Non-Patent Document 2, a Cu—Mg—Zn—B alloy described in Patent Document 2, and the like have been developed.

In the Cu—Mg based alloy, as is known from a Cu—Mg system phase diagram shown in FIG. 1, in a case where the Mg content is in a range of 3.3 at % or more, a solutionizing treatment (500° C. to 900° C.) and a precipitation treatment are performed so that intermetallic compounds including Cu and Mg can precipitate. That is, even in the Cu—Mg based alloy, relatively high electrical conductivity and strength can be achieved by precipitation hardening as is the case with the above-mentioned Corson alloy.

PRIOR ART DOCUMENTS

Patent Documents

Patent Document 1: Japanese Unexamined Patent Application, First Publication No. H11-036055

Patent Document 2: Japanese Unexamined Patent Application, First Publication No. H07-018354

Non-Patent Document

Non-Patent Document 1: Koya Nomura, "Technical Trends in High Performance Copper Alloy Strip for Connector and Kobe Steel's Development Strategy", Kobe Steel Engineering reports Vol. 54, No. 1 (2004), p. 2 to 8

Non-Patent Document 2: Shigenori Hori and two co-researchers, "Intergranular (Grain Boundary) Precipitation in Cu—Mg Alloy", Journal of the Japan Copper and Brass Research Association, Vol. 19 (1980), p. 115 to 124

Problems to be Solved by the Invention

However, the Corson alloy disclosed in Patent Document 1 has a Young's modulus of 126 to 135 GPa, which is relatively high. Here, in the connecter having the structure in which the male tab is inserted by pushing up the spring contact portion of the female, when the Young's modulus of the material of the connector is high, the contact pressure fluctuates during the insertion, the contact pressure easily exceeds the elastic limit, and there is concern for plastic deformation, which is not preferable.

In addition, in the Cu—Mg based alloy disclosed in Non-Patent Document 2 and Patent Document 2, the intermetallic compounds including Cu and Mg precipitate, and the Young's modulus tends to be high. Therefore, as described above, the Cu—Mg based alloy is not preferable as the connector.

Moreover, many coarse intermetallic compounds including Cu and Mg are dispersed in a matrix phase, and thus cracking is likely to occur from the intermetallic compounds as the start points during bending. Therefore, there is a problem in that a component for electronic devices having a complex shape cannot be formed.

The present invention has been made taking the foregoing circumstances into consideration, and an object thereof is to provide a copper alloy for electronic devices which has low Young's modulus, high proof stress, high electrical conductivity, and excellent bending formability and is appropriate for a component for electronic devices such as a terminal including a connector, a relay, and a lead frame, a method of manufacturing a copper alloy for electronic devices, a copper alloy plastic working material for electronic devices, and a component for electronic devices.

SUMMARY OF THE INVENTION

Means for Solving the Problems

In order to solve the problems, the inventors had intensively researched, and as a result, they learned that a work hardening type copper alloy of a Cu—Mg solid solution alloy supersaturated with Mg produced by solutionizing a Cu—Mg alloy and performing rapid cooling thereon has low Young's modulus, high proof stress, high electrical conductivity, and excellent bending formability. In addition, it was found that proof stress can be enhanced and bending formability can be ensured by controlling the average grain size in the copper alloy made from the Cu—Mg solid solution alloy supersaturated with Mg.

The present invention has been made based on the above-described knowledge, and a copper alloy for electronic devices according to one aspect of the present invention consists of a binary alloy of Cu and Mg, wherein the binary alloy contains Mg at a content of 3.3 at % or more and 6.9 at % or less, with a remainder being Cu and unavoidable impurities, when a concentration of Mg is given as X at %, an electrical conductivity σ (% IACS) is in a range of $\sigma \leq \{1.7241/(-0.0347 \times X^2+0.6569 \times X+1.7)\} \times 100$, and an average grain size is in a range of 1 μm or greater and 100 μm or smaller.

In addition, a copper alloy for electronic devices according to another aspect of the present invention consists of a binary alloy of Cu and Mg, wherein the binary alloy contains Mg at a content of 3.3 at % or more and 6.9 at % or less, with a remainder being Cu and unavoidable impurities, when a concentration of Mg is given as X at %, an electrical conductivity σ (% IACS) is in a range of $\sigma \leq \{1.7241/(-0.0347 \times X^2+0.6569 \times X+1.7)\} \times 100$, and an average grain size of a copper material after an intermediate heat treatment and before finishing working is in a range of 1 μm or greater and 100 μm or smaller.

In the copper alloy for electronic devices having the above configuration, Mg is contained at a content of 3.3 at % or more and 6.9 at % or less so as to be equal to or more than a solid solubility limit, and the electrical conductivity σ is set to be in the range of the above expression when the Mg content is given as X at %. Therefore, the copper alloy is the Cu—Mg solid solution alloy supersaturated with Mg.

The copper alloy made from the Cu—Mg solid solution alloy supersaturated with Mg has tendency to decrease the Young's modulus, and for example, even when the copper alloy is applied to a connector in which a male tab is inserted by pushing up a spring contact portion of a female or the like, a change in contact pressure during the insertion is suppressed, and due to a wide elastic limit, there is no concern for plastic deformation easily occurring. Therefore, the copper alloy is particularly appropriate for a component for electronic devices such as a terminal including a connector, a relay, and a lead frame.

In addition, since the copper alloy is supersaturated with Mg, coarse intermetallic compounds, which are the start points of cracks, are not largely dispersed in the matrix, and bending formability is enhanced. Therefore, a component for electronic devices having a complex shape such as a terminal including a connector, a relay, and a lead frame can be formed.

Moreover, since the copper alloy is supersaturated with Mg, strength can be increased by work hardening.

In addition, in the copper alloy for electronic devices according to the one aspect and the other aspect of the present invention, since the average grain size is in a range of 1 μm or greater and 100 μm or smaller or the average grain size of the copper material after the intermediate heat treatment and before the finishing working is in a range of 1 μm or greater and 100 μm or smaller, proof stress can be enhanced.

In addition, since the grain size is in a range of 1 μm or greater, stress relaxation resistance can be ensured. Furthermore, since the grain size is in a range of 100 μm or less, bending formability can be enhanced.

Here, in the copper alloy for electronic devices according to the one aspect and the other aspect of the present invention, it is preferable that a ratio of a region having a CI (Confidence Index) value of 0.1 or less be in a range of 80% or less as a measurement result according to an SEM-EBSD method.

In this case, a worked structure is not greatly developed but a recrystallized structure is present. Therefore, bending formability can be ensured.

Furthermore, it is preferable that an average number of intermetallic compounds having grain sizes of 0.1 μm or greater and mainly containing Cu and Mg be in a range of 1 piece/$\mu m^2$ or less during observation by a scanning electron microscope.

In this case, the precipitation of the intermetallic compounds mainly containing Cu and Mg is suppressed, and the copper alloy is the Cu—Mg solid solution alloy supersaturated with Mg. Therefore, coarse intermetallic compounds mainly containing Cu and Mg, which are the start points of cracks, are not largely dispersed in the matrix, and bending formability is enhanced.

In addition, the average number of intermetallic compounds mainly containing Cu and Mg and having grain sizes of 0.1 μm or greater is calculated by observing 10 visual fields at a 50,000-fold magnification in a visual field of about 4.8 $\mu m^2$ using a field emission type scanning electron microscope.

In addition, the grain size of the intermetallic compound mainly containing Cu and Mg is the average value of a major axis of the intermetallic compound (the length of the longest intragranular straight line which is drawn under a condition without intergranular contact on the way) and a minor axis (the length of the longest straight line which is drawn under a condition without intergranular contact on the way in a direction perpendicular to the major axis).

Furthermore, in the copper alloy for electronic devices according to the one aspect and the other aspect of the present invention, a Young's modulus E is in a range of 125 GPa or less and a 0.2% proof stress $\sigma_{0.2}$ is in a range of 400 MPa or more.

In the case where Young's modulus E is in a range of 125 GPa or less and the 0.2% proof stress $\sigma_{0.2}$ is in a range of 400 MPa or more, the elastic energy coefficient ($\sigma_{0.2}{}^2/2E$) is increased, and thus plastic deformation does not easily occur. Therefore, the copper alloy is particularly appropriate for a component for electronic devices such as a terminal including a connector, a relay, and a lead frame.

A method of manufacturing a copper alloy for electronic devices according to an aspect of the present invention is a method of manufacturing the above-described copper alloy for electronic devices, and the method includes: an intermediate working process of subjecting a copper material, which consists of a binary alloy of Cu and Mg and has a composition that contains Mg at a content of 3.3 at % or more and 6.9 at % or less with a remainder being Cu and unavoidable impurities, to cold or warm plastic working into a predetermined shape; and an intermediate heat treatment process of heat-treating the copper material subjected to the plastic working in the intermediate working process, wherein an average grain size of the copper material after the intermediate heat treatment process is in a range of 1 μm or greater and 100 μm or smaller.

According to the method of manufacturing a copper alloy for electronic devices having the above configuration, by the intermediate working process of subjecting the copper material having the above-described composition to cold or warm plastic working into the predetermined shape and the intermediate heat treatment process of heat-treating the copper material subjected to the plastic working in the intermediate working process, the copper material has a fine recrystallized structure, and the average grain size is in a range of 1 μm or greater and 100 μm or smaller. Accordingly, the copper alloy for electronic devices having high proof stress and excellent bending formability can be manufactured.

It is preferable that in the intermediate working process, the plastic working be performed at a working ratio of 50% or higher in a range of −200° C. to 200° C., and in the intermediate heat treatment process, after performing heating to a temperature of 400° C. or higher and 900° C. or lower and performing holding for a predetermined time, cooling to a temperature of 200° C. or lower at a cooling rate of 200° C./min or higher be performed.

In this case, in the intermediate working process, strain is introduced to the copper material, and the recrystallized structure is made in the intermediate heat treatment process. Therefore, the average grain size of the copper material after the intermediate heat treatment process can be in a range of 1 μm or greater and 100 μm or smaller. In addition, due to the configuration in which the cooling is performed at a cooling rate of 200° C./min or higher, the precipitation of the intermetallic compounds mainly containing Cu and Mg is suppressed, and the copper alloy of the Cu—Mg solid solution alloy supersaturated with Mg can be manufactured.

A copper alloy plastic working material for electronic devices according to an aspect of the present invention consists of the copper alloy for electronic devices described above, wherein a Young's modulus E is in a range of 125 GPa or less and a 0.2% proof stress $\sigma_{0.2}$ is in a range of 400 MPa or more.

According to the copper alloy plastic working material for electronic devices having this configuration, the elastic energy coefficient ($\sigma_{0.2}^2/2E$) is high, and plastic deformation does not easily occur.

In addition, the plastic working material in this specification is referred to as a copper alloy subjected to plastic working in any one of the manufacturing processes.

In addition, it is preferable that the copper alloy plastic working material for electronic devices described above be used as a copper material included in a terminal including a connector, a relay, and a lead frame.

Furthermore, a component for electronic devices according to an aspect of the present invention includes the copper alloy for electronic devices described above.

Since the component for electronic devices having this configuration (for example, a terminal including a connector, a relay, and a lead frame) has low Young's modulus and high proof stress, the elastic energy coefficient ($\sigma_{0.2}^2/2E$) is high, and plastic deformation does not easily occur.

Effects of the Invention

According to the present invention, a copper alloy for electronic devices which has low Young's modulus, high proof stress, high electrical conductivity, and excellent bending formability and is appropriate for a component for electronic devices such as a terminal including a connector, a relay, and a lead frame, a method of manufacturing a copper alloy for electronic devices, a copper alloy plastic working material for electronic devices, and a component for electronic devices can be provided.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Embodiments of the Invention

Figure 1:
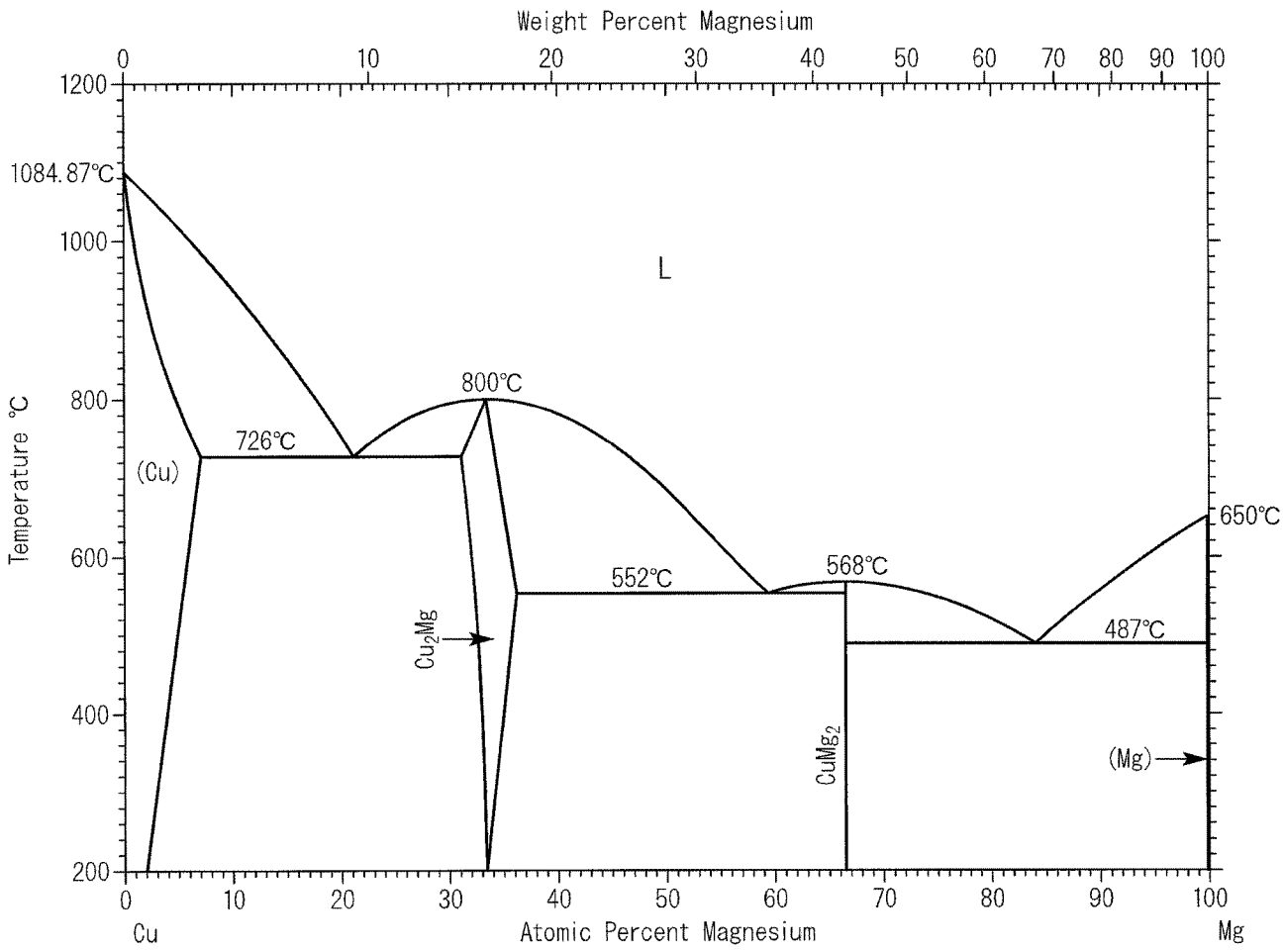
FIG. 1 is a Cu—Mg system phase diagram.

Hereinafter, a copper alloy for electronic devices according to an embodiment of the present invention will be described.

The copper alloy for electronic devices according to this embodiment is a binary alloy of Cu and Mg, which contains Mg at a content of 3.3 at % or more and 6.9 at % or less, with a remainder being Cu and unavoidable impurities.

In addition, when the Mg content is given as X at %, the electrical conductivity σ (% IACS) is in a range of $\sigma \leq \{1.7241/(-0.0347 \times X^2 + 0.6569 \times X + 1.7)\} \times 100$.

In addition, during observation by a scanning electron microscope, the average number of intermetallic compounds mainly containing Cu and Mg and having grain sizes of 0.1 μm or greater is in a range of 1 piece/$\mu m^2$ or less.

In addition, the average grain size of the copper alloy for electronic devices is in a range of 1 μm or greater and 100 μm or smaller. In addition, the average grain size is more preferably in a range of 1 μm or greater and 50 μm or smaller, and is even more preferably in a range of 1 μm or greater and 30 μm or smaller.

Here, it is preferable that the average grain size be measured by an intercept method of JIS H 0501.

In addition, in a case where the grain size is in a range of greater than 10 μm, it is preferable that the average grain size be measured using an optical microscope. In contrast, in a case where the grain size is in a range of 10 μm or less, it is preferable that the average grain size be measured by an SEM-EBSD (Electron Backscatter Diffraction Patterns) measuring apparatus.

Furthermore, in the copper alloy for electronic devices according to this embodiment, as a measurement result according to the SEM-EBSD method, the ratio of a region having a CI value of 0.1 or less is in a range of 80% or less.

In addition, the copper alloy for electronic devices has a Young's modulus E of 125 GPa or less and a 0.2% proof stress $\sigma_{0.2}$ of 400 MPa or more.

(Composition)

Mg is an element having an operational effect of increasing strength and increasing recrystallization temperature without large reduction in electrical conductivity. In addition, by solid-solubilizing Mg in a matrix phase, Young's modulus is suppressed to be low and excellent bending formability can be obtained.

Here, when the Mg content is in a range of less than 3.3 at %, the operational effect thereof cannot be achieved. In contrast, when the Mg content is in a range of more than 6.9 at %, the intermetallic compounds mainly containing Cu and Mg remain in a case where a heat treatment is performed for solutionizing, and thus there is concern that cracking may occur in subsequent plastic works.

For this reason, the Mg content is set to be in a range of 3.3 at % or more and 6.9 at % or less.

Moreover, when the Mg content is low, strength is not sufficiently increased, and Young's modulus cannot be suppressed to be sufficiently low. In addition, since Mg is an active element, when Mg is excessively added, there is concern that an Mg oxide generated by a reaction between Mg and oxygen may be incorporated during melting and casting. Therefore, it is more preferable that the Mg content be in a range of 3.7 at % or more and 6.3 at % or less.

In addition, examples of the unavoidable impurities include Sn, Zn, Al, Ni, Fe, Co, Ag, Mn, B, P, Ca, Sr, Ba, Sc, Y, a rare earth element, Cr, Zr, Hf, V, Nb, Ta, Mo, W, Re, Ru, Os, Se, Te, Rh, Ir, Pd, Pt, Au, Cd, Ga, In, Li, Si, Ge, As, Sb, Ti, Ti, Pb, Bi, S, O, C, Be, N, H, and Hg. The total amount of unavoidable impurities is desirably in a range of 0.3 mass % or less in terms of the total amount. Particularly, it is preferable that the amount of Sn be in a range of less than 0.1 mass %, and the amount of Zn be in a range of less than 0.01 mass %. This is because when 0.1 mass % or more of Sn is added, precipitation of the intermetallic compounds mainly containing Cu and Mg is likely to occur, and when 0.01 mass % or more of Zn is added, fumes are generated in a melting and casting process and adhere to members such as a furnace or mold, resulting in the deterioration of the surface quality of an ingot and the deterioration of stress corrosion cracking resistance.

(Electrical Conductivity σ)

When the Mg content is given as X at %, in a case where the electrical conductivity σ is in a range of $\sigma \leq \{1.7241/(-0.0347 \times X^2+0.6569 \times X+1.7)\} \times 100$ in the binary alloy of Cu and Mg, the intermetallic compounds mainly containing Cu and Mg are rarely present.

That is, in a case where the electrical conductivity σ is higher than that of the above expression, a large amount of the intermetallic compounds mainly containing Cu and Mg are present and the size thereof is relatively large, and thus bending formability greatly deteriorates. In addition, since the intermetallic compounds mainly containing Cu and Mg are formed and the amount of solid-solubilized Mg is small, the Young's modulus is also increased. Therefore, manufacturing conditions are adjusted so that the electrical conductivity σ is in the range of the above expression.

In addition, in order to reliably achieve the operational effect, it is preferable that the electrical conductivity σ (% IACS) be in a range of $\sigma \leq \{1.7241/(-0.0300 \times X^2+0.6763 \times X+1.7)\} \times 100$. In this case, a smaller amount of the intermetallic compounds mainly containing Cu and Mg is contained, and thus bending formability is further enhanced.

In order to further reliably achieve the operational effect, the electrical conductivity σ (% IACS) is more preferably in a range of $\sigma \leq \{1.7241/(-0.0292 \times X^2+0.6797 \times X+1.7)\} \times 100$. In this case, a further smaller amount of the intermetallic compounds mainly containing Cu and Mg is contained, and thus bending formability is further enhanced.

(CI Value)

In a case where the ratio of measurement points having CI values of 0.1 or less is in a range of more than 80%, strain introduced during working is high, a large worked structure is developed, and thus there is concern that bending formability may deteriorate. Therefore, the ratio of the measurement points having CI values of 0.1 or less is preferably in a range of 80% or less. The range of the ratio of the above-described measurement points is more preferably in a range of 3% or more to 75% or less, and even more preferably in a range of 5% or more to 70% or less.

In addition, the CI value is a value measured by the analysis software OIM Analysis (Ver. 5.3) of the EBVD apparatus, and the CI value becomes in a range of 0.1 or less when a crystal pattern of an evaluated analysis point is not good (that is, there is a worked structure). Therefore, in a case where the ratio of the measurement points having CI values of 0.1 or less is in a range of 80% or less, a structure having a relatively low strain is maintained, and thus bending formability is ensured.

(Structure)

In the copper alloy for electronic devices according to this embodiment, as a result of the observation by the scanning electron microscope, the average number of intermetallic compounds mainly containing Cu and Mg and having grain sizes of 0.1 μm or greater is in a range of 1 piece/$\mu m^2$ or less. That is, the intermetallic compounds mainly containing Cu and Mg rarely precipitate, and Mg is solid-solubilized in the matrix phase.

Here, when solutionizing is incomplete or the intermetallic compounds mainly containing Cu and Mg precipitate after the solutionizing and thus a large amount of the intermetallic compounds having large sizes are present, the intermetallic compounds becomes the start points of cracks, and cracking occurs during working or bending formability greatly deteriorates. In addition, when the amount of the intermetallic compounds mainly containing Cu and Mg is large, the Young's modulus is increased, which is not preferable. In addition, the upper limit of the grain size of the intermetallic compound generated in the copper alloy of the present invention is preferably 5 μm, and is more preferably 1 μm.

As a result of the observation of the structure, in a case where the intermetallic compounds mainly containing Cu and Mg and having grain sizes of 0.1 μm or greater is in a range of 1 piece/$\mu m^2$ or less in the alloy, that is, in a case where the intermetallic compounds mainly containing Cu and Mg are absent or account for a small amount, good bending formability and low Young's modulus can be obtained.

Furthermore, in order to reliably achieve the operational effect described above, it is more preferable that the number of intermetallic compounds mainly containing Cu and Mg and having grain sizes of 0.05 μm or greater in the alloy be in a range of 1 piece/$\mu m^2$ or less.

In addition, the average number of intermetallic compounds mainly containing Cu and Mg is obtained by observing 10 visual fields at a 50,000-fold magnification and a visual field of about 4.8 $\mu m^2$ using a field emission type scanning electron microscope and calculating the average value thereof.

In addition, the grain size of the intermetallic compound mainly containing Cu and Mg is the average value of a major axis of the intermetallic compound (the length of the longest intragranular straight line which is drawn under a condition without intergranular contact on the way) and a minor axis (the length of the longest straight line which is drawn under a condition without intergranular contact on the way in a direction perpendicular to the major axis).

Figure 2:
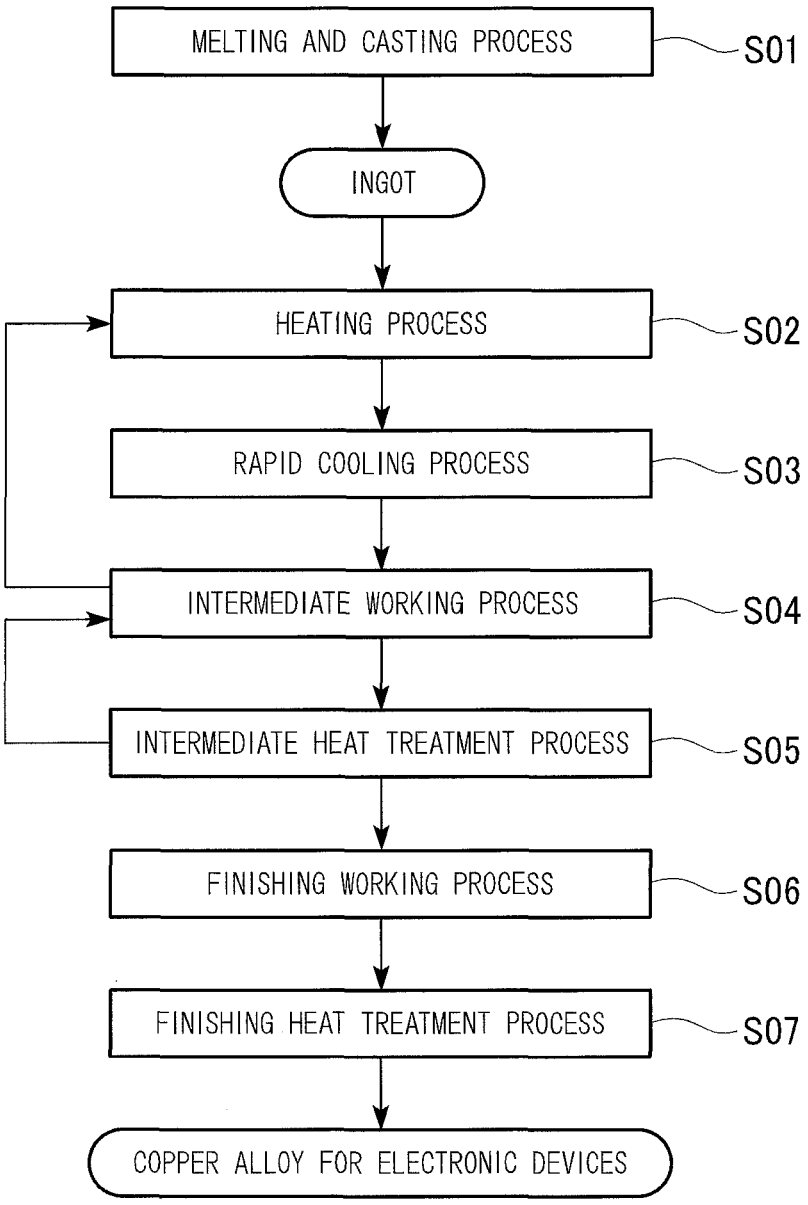
FIG. 2 is a flowchart of a method of manufacturing a copper alloy for electronic devices according to an embodiment.

Next, a method of manufacturing the copper alloy for electronic devices having the configuration according to this embodiment will be described with reference to a flowchart illustrated in FIG. 2.

In addition, in the manufacturing method described as follows, in a case where rolling is used as a working process, the working ratio corresponds to a rolling ratio.

(Melting and Casting Process S01)

First, the above-described elements are added to molten copper obtained by melting a copper raw material for component adjustment, thereby producing a molten copper alloy. Furthermore, for the addition of Mg, a single element of Mg, a Cu—Mg base alloy, or the like may be used. In addition, a raw material containing Mg may be melted together with the copper raw material. In addition, a recycled material and a scrap material of this alloy may be used.

Here, the molten copper is preferably a so-called 4NCu having a purity of 99.99 mass % or higher. In addition, in the meting process, in order to suppress the oxidation of Mg, a vacuum furnace or an atmosphere furnace in an inert gas atmosphere or in a reducing atmosphere is preferably used.

In addition, the molten copper alloy which is subjected to the component adjustment is poured into a mold, thereby producing the ingot. In addition, considering mass production, a continuous casting method or a semi-continuous casting method is preferably used.

(Heating Process S02)

Next, a heating treatment is performed for homogenization and solutionizing of the obtained ingot. Inside of the ingot, the intermetallic compounds mainly containing Cu and Mg and the like are present which are generated as Mg is condensed as segregation during solidification. Accordingly, in order to eliminate or reduce the segregation, the intermetallic compounds, and the like, a heating treatment of heating the ingot to a temperature of 400° C. or higher and 900° C. or lower is performed such that Mg is homogeneously diffused or Mg is solid-solubilized in the matrix phase inside of the ingot. In addition, the heating process S02 is preferably performed in a non-oxidizing or reducing atmosphere.

Here, when the heating temperature is in a range of less than 400° C., solutionizing is incomplete, and thus there is concern that a large amount of the intermetallic compounds mainly containing Cu and Mg may remain in the matrix phase. In contrast, when the heating temperature is in a range of higher than 900° C., a portion of the copper material becomes a liquid phase, and there is concern that the structure or the surface state thereof may become non-uniform. Therefore, the heating temperature is set to be in a range of 400° C. or higher and 900° C. or lower. The heating temperature is more preferably in a range of 500° C. or higher and 850° C. or lower, and even more preferably in a range of 520° C. or higher and 800° C. or lower.

(Rapid Cooling Process S03)

In addition, the copper material heated to a temperature of 400° C. or higher and 900° C. or lower in the heating process S02 is cooled to a temperature of 200° C. or lower at a cooling rate of 200° C./min or higher. By the rapid cooling process S03, Mg solid-solubilized in the matrix phase is suppressed from precipitating as the intermetallic compounds mainly containing Cu and Mg, and during observation by a scanning electron microscope, the average number of intermetallic compounds mainly containing Cu and Mg and having grain sizes of 0.1 μm or greater can be in a range of 1 piece/$\mu m^2$ or less. That is, the copper material can be a Cu—Mg solid solution alloy supersaturated with Mg.

In addition, for an increase in the efficiency of roughing and the homogenization of the structure, a configuration in which hot working is performed after the above-mentioned heating process S02 and the above-mentioned rapid cooling process S03 is performed after the hot working may be employed. In this case, the plastic working method is not particularly limited. For example, rolling may be employed in a case where the final form is a sheet or a strip, drawing, extruding, groove rolling, or the like may be employed in a case of a wire or a bar, and forging or press may be employed in a case of a bulk shape.

(Intermediate Working Process S04)

The copper material subjected to the heating process S02 and the rapid cooling process S03 is cut as necessary, and surface grinding is performed as necessary in order to remove an oxide film and the like generated in the heating process S02, the rapid cooling process S03, and the like. In addition, the resultant is subjected to plastic working to have a predetermined shape. By an intermediate working process S04, a recrystallized structure can be obtained after an intermediate heat treatment process S05, which will be described later.

In addition, the temperature condition in this intermediate working process S04 is not particularly limited, and is preferably in a range of −200° C. to 200° C. for cold working or warm working. In addition, the working ratio is appropriately selected to approximate a final shape, and is preferably in a range of 20% or higher in order to obtain the recrystallized structure. The upper limit of the working ratio is not particularly limited, and is preferably 99.9% from the viewpoint of preventing an edge crack.

Here, the plastic working method is not particularly limited. For example, rolling may be employed in a case where the final form is a sheet or a strip, drawing, extruding, or groove rolling, may be employed in a case of a wire or a bar, and forging or press may be employed in a case of a bulk shape. Furthermore, for thorough solutionizing, S02 to S04 may be repeated.

(Intermediate Heat Treatment Process S05)

After the intermediate working process S04, a heat treatment is performed for the purpose of thorough solutionizing and softening to recrystallize the structure or to improve formability.

Here, a temperature condition of the intermediate heat treatment is not particularly limited, and is preferably in a range of 400° C. or higher and 900° C. or lower in order to substantially obtain the recrystallized structure. The temperature condition is more preferably in a range of 500° C. or higher and 800° C. or lower. In addition, it is preferable that the heat treatment be performed in a non-oxidizing atmosphere or a reducing atmosphere.

Here, in the intermediate heat treatment process S05, the copper material heated to a temperature of 400° C. or higher and 900° C. or lower is cooled to a temperature of 200° C. or lower at a cooling rate of 200° C./min or higher.

By the rapid cooling, Mg solid-solubilized in the matrix phase is suppressed from precipitating as the intermetallic compounds mainly containing Cu and Mg, and during observation by a scanning electron microscope, the average number of intermetallic compounds mainly containing Cu and Mg and having grain sizes of 0.1 μm or greater can be in a range of 1 piece/$\mu m^2$ or less. That is, the copper material can be a Cu—Mg solid solution alloy supersaturated with Mg.

In addition, the intermediate working process S04 and the intermediate heat treatment process S05 may be repeatedly performed.

(Finishing Working Process S06)

Finish plastic working is performed on the copper material after being subjected to the intermediate heat treatment process S05 so as to have a predetermined shape. By the finishing working process S06, proof stress can be enhanced. In addition, a temperature condition in the finishing working process S06 is not particularly limited, and the finishing working process S06 is preferably performed at a temperature of −200° C. or higher and 200° C. or lower. In addition, the working ratio is appropriately selected to approximate a final shape, and is preferably in a range of 0% to 95%. The working ratio is more preferably in a range of 10 to 80%.

Here, the plastic working method is not particularly limited. For example, rolling may be employed in a case where the final form is a sheet or a strip, drawing, extruding, groove rolling, or the like may be employed in a case of a wire or a bar, and forging or press may be employed in a case of a bulk shape.

(Finishing Heat Treatment Process S07)

Next, a finishing heat treatment is performed on the plastic working material obtained in the finishing working process 06 in order to enhance stress relaxation resistance, perform annealing and hardening at low temperature, or remove residual strain.

The heat treatment temperature is preferably in a range of higher than 200° C. and 800° C. or lower. In addition, in the finishing heat treatment process S07, heat treatment conditions (temperature, time, and cooling rate) need to be set so that the solutionized Mg does not precipitate. For example, it is preferable that the conditions be about 10 seconds to 24 hours at 250° C., about 5 seconds to 4 hours at 300° C., and about 0.1 seconds to 60 seconds at 500° C. The finishing heat treatment process S07 is preferably performed in a non-oxidizing atmosphere or a reducing atmosphere.

In addition, a cooling method of cooling the heated copper material to a temperature of 200° C. or lower at a cooling rate of 200° C./min or higher, such as water quenching, is preferable. By the rapid cooling, Mg solid-solubilized in the matrix phase is suppressed from precipitating as the intermetallic compounds mainly containing Cu and Mg, and during observation by a scanning electron microscope, the average number of intermetallic compounds mainly containing Cu and Mg and having grain sizes of 0.1 μm or greater can be in a range of 1 piece/$\mu m^2$ or less. That is, the copper material can be a Cu—Mg solid solution alloy supersaturated with Mg.

Furthermore, the finishing working process S06 and the finishing heat treatment process S07 described above may be repeatedly performed. In addition, the intermediate heat treatment process and the finishing heat treatment process can be distinguished by whether or not recrystallization of the structure after the plastic working is the object in the intermediate working process or the finishing working process.

In this manner, the copper alloy for electronic devices according to this embodiment is produced. In addition, the copper alloy for electronic devices according to this embodiment has a Young's modulus E of 125 GPa or less and a 0.2% proof stress $\sigma_{0.2}$ of 400 MPa or more.

In addition, when the Mg content is given as X at %, the electrical conductivity σ (% IACS) is set to be in a range of $\sigma \leq \{1.7241/(-0.0347 \times X^2+0.6569 \times X+1.7)\} \times 100$.

Furthermore, the copper alloy for electronic devices according to this embodiment has an average grain size in a range of 1 μm or greater and 100 μm or smaller.

In addition, in the copper alloy for electronic devices according to this embodiment, as a measurement result according to the SEM-EBSD method, the ratio of a region having a CI value of 0.1 or less is in a range of 80% or less.

According to the copper alloy for electronic devices having the above-described configuration according to this embodiment, Mg is contained in the binary alloy of Cu and Mg at a content of 3.3 at % or more and 6.9 at % or less so as to be equal to or more than a solid solubility limit, and the electrical conductivity σ (% IACS) is set to be in a range of $\sigma \leq 1.7241/(-0.0347 \times X^2+0.6569 \times X+1.7) \times 100$ when the Mg content is given as X at %. Furthermore, during the observation by a scanning electron microscope, the average number of intermetallic compounds containing Cu and Mg and having grain sizes of 0.1 μm or greater is in a range of 1 piece/$\mu m^2$ or less.

That is, the copper alloy for electronic devices according to this embodiment is the Cu—Mg solid solution alloy supersaturated with Mg.

The copper alloy made from the Cu—Mg solid solution alloy supersaturated with Mg has tendency to decrease the Young's modulus, and for example, even when the copper alloy is applied to a connector in which a male tab is inserted by pushing up a spring contact portion of a female or the like, a change in contact pressure during the insertion is suppressed, and due to a wide elastic limit, there is no concern for plastic deformation easily occurring. Therefore, the copper alloy is particularly appropriate for a component for electronic devices such as a terminal including a connector, a relay, and a lead frame.

In addition, since the copper alloy is supersaturated with Mg, coarse intermetallic compounds mainly containing Cu and Mg, which are the start points of cracks, are not largely dispersed in the matrix, and bending formability is enhanced. Therefore, a component for electronic devices having a complex shape such as a terminal including a connector, a relay, and a lead frame can be formed.

Moreover, since the copper alloy is supersaturated with Mg, strength is increased through work hardening, and thus a relatively high strength can be achieved.

In addition, since the copper alloy consists of the binary alloy of Cu and Mg containing Cu, Mg, and the unavoidable impurities, a reduction in the electrical conductivity due to other elements is suppressed, and thus a relatively high electrical conductivity can be achieved.

In addition, in the copper alloy for electronic devices according to this embodiment, since the average grain size is in a range of 1 μm or greater and 100 μm or smaller, a proof stress value is increased. Specifically, since the Young's modulus E is in a range of 125 GPa or less and the 0.2% proof stress $\sigma_{0.2}$ is in a range of 400 MPa or more, an elastic energy coefficient ($\sigma_{0.2}{}^2/2E$) is increased, and thus plastic deformation does not easily occur.

In addition, in the copper alloy for electronic devices according to this embodiment, since the average grain size is in a range of 1 μm or greater, stress relaxation resistance can be ensured. Furthermore, since the grain size is in a range of 100 μm or less, bending formability can be ensured.

As described above, the copper alloy for electronic devices according to this embodiment has low Young's modulus, high proof stress, high electrical conductivity, and excellent bending formability and is appropriate for a component for electronic devices such as a terminal including a connector, a relay, and a lead frame.

According to the method of manufacturing the copper alloy for electronic devices according to this embodiment, by the heating process S02 of heating the ingot or the plastic working material consisting of the binary alloy of Cu and Mg and having the above composition to a temperature of 400° C. or higher and 900° C. or lower, the solutionizing of Mg can be achieved.

In addition, since the rapid cooling process S03 of cooling the ingot or the plastic working material which is heated to a temperature of 400° C. or higher and 900° C. or lower in the heating process S02 to a temperature of 200° C. or lower at a cooling rate of 200° C./min or higher is included, the intermetallic compounds mainly containing Cu and Mg can be suppressed from precipitating in the cooling procedure, and thus the ingot or the plastic working material after the rapid cooling can be the Cu—Mg solid solution alloy supersaturated with Mg.

Moreover, since the intermediate working process S04 of performing plastic working on the rapidly-cooled material (the Cu—Mg solid solution alloy supersaturated with Mg) is included, a shape close the final shape can be easily obtained.

In addition, after the intermediate working process S04, since the intermediate heat treatment process S05 is included for the purpose of thorough solutionizing and the softening to recrystallize the structure or to improve formability, properties and formability can be improved.

In addition, in the intermediate heat treatment process S05, since the copper material heated to a temperature of 400° C. or higher and 900° C. or lower is cooled to a temperature of 200° C. or lower at a cooling rate of 200° C./min or higher, the intermetallic compounds mainly containing Cu and Mg can be suppressed from precipitating in the cooling procedure, and thus the copper material after the rapid cooling can be the Cu—Mg solid solution alloy supersaturated with Mg.

While the copper alloy for electronic devices according to this embodiment of the present invention has been described above, the present invention is not limited thereto and can be appropriately modified in a range that does not depart from the technical features of the invention.

For example, in the above-described embodiment, an example of the method of manufacturing the copper alloy for electronic devices is described. However, the manufacturing method is not limited to this embodiment, and the copper alloy may be manufactured by appropriately selecting existing manufacturing methods.

EXAMPLES

Hereinafter, results of confirmation tests performed to confirm the effects of the present invention will be described.

A copper raw material consisting of oxygen-free copper (ASTM B152 C10100) having a purity of 99.99 mass % or higher was prepared, the copper material was inserted into a high purity graphite crucible, and subjected to high frequency melting in an atmosphere furnace having an Ar gas atmosphere. Various additional elements were added to the obtained molten copper to prepare component compositions shown in Tables 1 and 2, and the resultant was poured into a carbon mold, thereby producing an ingot. In addition, the dimensions of the ingot were about 20 mm in thickness× about 20 mm in width×about 100 to 120 mm in length.

A heating process of heating the obtained ingot in the Ar gas atmosphere for 4 hours under the temperature conditions shown in Tables 1 and 2 was performed. Thereafter, water quenching was performed thereon.

The ingot after the heat treatment was cut, and surface grinding was performed to remove oxide films.

Thereafter, at the room temperature, intermediate rolling was performed at a rolling ratio shown in Tables 1 and 2. In addition, an intermediate heat treatment was performed on the obtained strip material in a salt bath under the temperature conditions shown in Tables 1 and 2. Thereafter, water quenching was performed.

Subsequently, finish rolling was performed at a rolling ratio shown in Tables 1 and 2, thereby producing a strip material having a thickness of 0.25 mm and a width of about 20 mm.

In addition, after the finish rolling, a finishing heat treatment was performed in a salt bath under the conditions shown in Tables. Thereafter, water quenching was performed on the resultant, thereby producing a strip material for property evaluation.

(Grain Size after Intermediate Heat Treatment/Grain Size after Finish Rolling)

Mirror polishing and etching were performed on each sample, the sample was photographed by an optical microscope so that the rolling direction thereof was the horizontal direction of the photograph, and the observation was performed in a visual field at a 1,000-fold magnification (about 300 μm×200 $\mu m^2$). In addition, regarding the grain size, according to the intercept method of JIS H 0501, 5 segments having vertically and horizontally predetermined lengths were drawn in the photograph, the number of crystal grains which were completely cut was counted, and the average value of the cut lengths thereof was calculated as the average grain size.

In addition, in a case where the average grain size is in a range of 10 μm or less, the average grain size is measured by the SEM-EBSD (Electron Backscatter Diffraction Patterns) measuring apparatus. After mechanical polishing was performed using waterproof abrasive paper or diamond abrasive grains, finish polishing was performed using a colloidal silica solution. Thereafter, using a scanning electron microscope, each of measurement points (pixels) in a measurement range on the surface of the sample was irradiated with an electron beam, and through orientation analysis according to electron backscatter diffraction, an interval between the measurement points having an orientation difference between the adjacent measurement points of 15° or higher was referred to as high-angle grain boundary, and an interval having an orientation difference of 15° or less was referred to as low-angle grain boundary. A crystal grain boundary map was made using the high-angle grain boundaries, 5 segments having vertically and horizontally predetermined lengths were drawn in the crystal grain boundary map according to the intercept method of JIS H 0501, the number of crystal grains which were completely cut was counted, and the average value of the cut lengths thereof was referred to as the average grain size.

(CI Value)

Mechanical polishing was performed on a surface of the strip material for property evaluation, which was perpendicular to a width direction of the rolling, that is, a TD (Transverse Direction) surface, using waterproof abrasive paper or diamond abrasive grains, and thereafter finish polishing was performed using a colloidal silica solution. In addition, by an EBSD measuring apparatus (Quanta FEG 450 manufactured by FEI Company, and OIM Data Collection manufactured by EDAX/TSL Company (currently AMETEK Co., Ltd.)) and analysis software (OIM Data Analysis ver. 5.3 manufactured by EDAX/TSL Company (currently AMETEK Co., Ltd.)), a region of 100 μm×100 μm was measured in a step of 0.1 μm at an accelerating voltage of an electron beam of 20 kV and an observation at a 300-fold magnification, and analysis of the orientation difference between crystal grains was performed. The CI value of each of the measurement points was calculated using the analysis software. Thereafter, the ratio of the measurement points having CI values of 0.1 or less to the total measurement points was calculated. For the measurement, visual fields which did not have unique structures were selected from each of the strip materials, 10 visual fields were measured, and the average value thereof was used as a value.

(Formability Evaluation)

As formability evaluation, presence or absence of an edge crack occurred during the above-mentioned intermediate rolling was observed. The samples in which no or substantially no edge cracks were visually confirmed were evaluated as A, the samples in which small edge cracks having lengths of less than 1 mm had occurred were evaluated as B, the samples in which edge cracks having lengths of 1 mm or greater and less than 3 mm had occurred were evaluated as C, the samples in which large edge cracks having lengths of 3 mm or greater had occurred were evaluated as D, and the samples which were fractured during the rolling due to edge cracks were evaluated as E.

In addition, the length of the edge crack is the length of an edge crack directed from an end portion of a rolled material in a width direction to a center portion in the width direction.

In addition, using the strip material for property evaluation described above, mechanical properties and electrical conductivity were measured.

(Mechanical Properties)

A No. 13B specimen specified in Z 2201 was collected from the strip material for property evaluation, and the 0.2% proof stress $\sigma_{0.2}$ thereof was measured by an offset method in JIS Z 2241. In addition, the specimen was collected in a direction parallel to the rolling direction.

The Young's modulus E was obtained from the gradient of a load-elongation curve by applying a strain gauge to the specimen described above.

(Electrical Conductivity)

A specimen having a size of 10 mm in width×60 mm in length was collected from the strip material for property evaluation, and the electrical resistance thereof was obtained by a four terminal method. In addition, the dimensions of the specimen were measured using a micrometer, and the volume of the specimen was calculated. In addition, the electrical conductivity thereof was calculated from the measured electrical resistance and the volume. In addition, the specimen was collected so that the longitudinal direction thereof was parallel to the rolling direction of the strip material for property evaluation.

(Bending Formability)

Bending based on the test method of JCBA-T307:2007-4 of The Japan Copper and Brass Association Technical Standards was performed.

A plurality of specimens having a size of 10 mm in width×30 mm in length were collected from the strip material for property evaluation so that the rolling direction and the longitudinal direction of the specimen were parallel to each other, a W bending test was performed using a W-shaped jig having a bending angle of 90 degrees and a bending radius of 0.25 mm.

In addition, the outer peripheral portion of a bent portion was visually checked, and a case where a fracture had occurred was evaluated as D, a case where only a partial fracture had occurred evaluated as C, a case where only a fine crack had occurred without fracturing was evaluated as B, and a case where no fracture or fine crack could be confirmed was evaluated as A.

(Structure Observation)

Mirror polishing and ion etching were performed on the rolled surface of each sample. In order to check the precipitation state of the intermetallic compounds mainly containing Cu and Mg, observation was performed in a visual field at a 10,000-fold magnification (about 120 $\mu m^2$/visual field) using an FE-SEM (field emission type scanning electron microscope).

Subsequently, in order to examine the density (pieces/$\mu m^2$) of the intermetallic compounds mainly containing Cu and Mg, a visual field at a 10,000-fold magnification (about 120 $\mu m^2$/visual field) in which the precipitation state of the intermetallic compounds was not unusual was selected, and in the region, 10 continuous visual fields (about 4.8 $\mu m^2$/visual field) were photographed at a 50,000-fold magnification. The grain size of the intermetallic compound was obtained from the average value of a major axis of the intermetallic compound (the length of the longest intragranular straight line which is drawn under a condition without intergranular contact on the way) and a minor axis (the length of the longest straight line which is drawn under a condition without intergranular contact on the way in a direction perpendicular to the major axis). In addition, the density (pieces/$\mu m^2$) of the intermetallic compounds mainly containing Cu and Mg and having grain sizes of 0.1 μm was obtained.

The conditions and the evaluation results are shown in Tables 1 to 4.

TABLE 1

| | | Additional element Mg (at %) | Temperature of heating process | Rolling ratio of intermediate rolling | Temperature of intermediate heat treatment | Rolling ratio of finish rolling | Finishing heat treatment Temperature | Finishing heat treatment Time |
|---|---|---|---|---|---|---|---|---|
| Invention Examples | 1 | 3.4 | 715° C. | 50% | 550° C. | 50% | 250° C. | 1 m |
| | 2 | 4.0 | 715° C. | 90% | 550° C. | 50% | 300° C. | 1 m |
| | 3 | 4.1 | 715° C. | 65% | 550° C. | 60% | 300° C. | 1 m |
| | 4 | 4.2 | 715° C. | 80% | 550° C. | 65% | 300° C. | 50 s |
| | 5 | 4.5 | 715° C. | 60% | 625° C. | 60% | 300° C. | 10 s |
| | 6 | 5.2 | 715° C. | 60% | 650° C. | 60% | 250° C. | 20 s |
| | 7 | 5.4 | 715° C. | 50% | 650° C. | 60% | 250° C. | 30 s |
| | 8 | 5.9 | 715° C. | 45% | 700° C. | 60% | 240° C. | 10 m |
| | 9 | 6.4 | 715° C. | 80% | 700° C. | 60% | 260° C. | 1 s |
| | 10 | 4.4 | 715° C. | 50% | 600° C. | 25% | 230° C. | 10 s |
| | 11 | 4.4 | 715° C. | 50% | 600° C. | 50% | 240° C. | 10 s |
| | 12 | 4.4 | 715° C. | 50% | 600° C. | 75% | 230° C. | 10 s |
| | 13 | 5.9 | 715° C. | 50% | 700° C. | 25% | 210° C. | 20 s |
| | 14 | 5.9 | 715° C. | 50% | 700° C. | 50% | 220° C. | 20 s |
| | 15 | 5.9 | 715° C. | 50% | 700° C. | 75% | 210° C. | 20 s |
| | 16 | 6.0 | 715° C. | 50% | 710° C. | 90% | 210° C. | 60 s |
| | 17 | 6.2 | 715° C. | 50% | 625° C. | 60% | 300° C. | 5 m |
| | 18 | 6.1 | 715° C. | 50% | 650° C. | 70% | 300° C. | 2 m |

TABLE 2

| | | Additional element Mg (at %) | Temperature of heating process | Rolling ratio of intermediate rolling | Temperature of intermediate heat treatment | Rolling ratio of finish rolling | Finishing heat treatment Temperature | Finishing heat treatment Time |
|---|---|---|---|---|---|---|---|---|
| Comparative Examples | 1 | 1.0 | 715° C. | 50% | 625° C. | 70% | 210° C. | 30 s |
| | 2 | 1.9 | 715° C. | 50% | 625° C. | 70% | 210° C. | 15 s |
| | 3 | 7.9 | 715° C. | 50% | — | — | — | — |
| | 4 | 10.3 | 715° C. | 50% | — | — | — | — |
| | 5 | 4.4 | 715° C. | 70% | 625° C. | 70% | 500° C. | 1 h |
| | 6 | 4.5 | 715° C. | 70% | 625° C. | 70% | 400° C. | 1 h |
| | 7 | 4.9 | 715° C. | 70% | 625° C. | 70% | 450° C. | 2 h |
| | 8 | 4.0 | 715° C. | 30% | 800° C. | 75% | 230° C. | 20 m |
| | 9 | 6.0 | 715° C. | 50% | 720° C. | 97% | 210° C. | 60 s |
| Conventional Example | | Cu—Ni—Si—Zn—Sn | 980° C. | 50% | 800° C. | 90% | 400° C. | 4 h |

TABLE 3

| | | Grain size after intermediate heat treatment (μm) | Grain size after finish rolling (μm) | Edge crack | Electrical conductivity % IACS | Upper limit of electrical conductivity | Precipitates (pieces/μm$^2$) | CI value | 0.2% proof stress MPa | Young's modulus GPa | Bending formability |
|---|---|---|---|---|---|---|---|---|---|---|---|
| Invention Examples | 1 | 7.8 | 12 | A | 45.1% | 48.8% | 0 | 10% | 586 | 115 | A |
| | 2 | 1.5 | 2.3 | A | 42.2% | 45.7% | 0 | 11% | 630 | 113 | A |
| | 3 | 7.6 | — | A | 42.4% | 45.3% | 0 | 17% | 600 | 113 | A |
| | 4 | 3.3 | — | A | 40.8% | 44.8% | 0 | 21% | 635 | 112 | A |
| | 5 | 13 | — | A | 36.9% | 43.6% | 0 | 19% | 620 | 111 | A |
| | 6 | 34 | — | A | 34.5% | 41.3% | 0 | 23% | 625 | 110 | A |
| | 7 | 32 | — | A | 34.1% | 40.7% | 0 | 24% | 641 | 107 | A |
| | 8 | 53 | — | B | 32.2% | 39.5% | 0 | 26% | 647 | 106 | A |
| | 9 | 51 | — | B | 31.8% | 38.5% | 0 | 29% | 670 | 104 | B |
| | 10 | 10 | 12 | A | 39.9% | 44.0% | 0 | 3% | 428 | 112 | A |
| | 11 | 10 | 15 | A | 38.2% | 44.0% | 0 | 13% | 586 | 112 | A |
| | 12 | 10 | — | A | 36.3% | 44.0% | 0 | 31% | 705 | 112 | B |
| | 13 | 56 | 65 | A | 35.1% | 39.5% | 0 | 4% | 451 | 107 | A |
| | 14 | 56 | 84 | B | 34.2% | 39.5% | 0 | 20% | 610 | 107 | A |
| | 15 | 56 | — | B | 33.1% | 39.5% | 0 | 60% | 764 | 107 | B |
| | 16 | 65 | — | B | 33.1% | 39.3% | 0 | 76% | 785 | 107 | B |
| | 17 | 4.0 | — | B | 36.6% | 38.8% | 0 | 31% | 673 | 108 | B |
| | 18 | 6.2 | — | B | 36.5% | 39.0% | 0 | 40% | 721 | 108 | B |

TABLE 4

| | | Grain size after intermediate heat treatment (μm) | Grain size after finish rolling (μm) | Edge crack | Electrical conductivity % IACS | Upper limit of electrical conductivity | Precipitates (pieces/μm$^2$) | CI value | 0.2% proof stress MPa | Young's modulus GPa | Bending formability |
|---|---|---|---|---|---|---|---|---|---|---|---|
| Comparative Examples | 1 | 14 | — | A | 73.1% | 74.2% | 0 | 11% | 433 | 127 | A |
| | 2 | 15 | — | A | 59.2% | 61.1% | 0 | 14% | 523 | 126 | A |
| | 3 | 56 | — | E | — | 36.5% | — | — | — | — | — |
| | 4 | 58 | — | E | — | 36.0% | — | — | — | — | — |
| | 5 | 13 | — | A | 44.8% | 44.0% | 10 | 10% | 330 | 128 | D |
| | 6 | 13 | — | A | 48.1% | 43.6% | 10 | 15% | 380 | 126 | D |
| | 7 | 14 | — | A | 47.2% | 42.2% | 11 | 13% | 370 | 127 | E |
| | 8 | 142 | — | B | 42.1% | 45.7% | 0 | 28% | 650 | 114 | C |
| | 9 | 106 | — | B | 34.2% | 39.3% | 0 | 83% | 832 | 105 | D |
| Invention Example | | 12 | — | B | 39.1% | — | — | — | 758 | 131 | B |

In Comparative Examples 1 and 2 in which the Mg content was lower than the range of the present invention, the Young's modulus was in a range of 127 GPa or 126 GPa, which was relatively high.

In addition, in Comparative Examples 3 and 4 in which the Mg contents were more than the range of the present invention, large edge cracks had occurred during intermediate rolling, and thus the subsequent property evaluation could not be performed.

Furthermore, in Comparative Examples 5 to 7 in which the Mg contents were in the range of the present invention but the electrical conductivity and the number of intermetallic compounds mainly containing Cu and Mg as main components were out of the ranges of the present invention, deterioration in proof stress and bending formability was confirmed. In Comparative Example 8 in which the Mg content was in the range of the present invention but the grain size after the intermediate heat treatment was out of the range of the present invention, deterioration in bending formability compared to Examples of Invention was confirmed.

Even in Comparative Example 9 in which the ratio of the region having a CI value of 0.1 or less was 83%, deterioration in bending formability compared to Examples of Invention was confirmed.

In addition, in a Cu—Ni—Si-based alloy (containing 3.0 at % of Cu, 1.6 at % of Ni, 0.5 at % of Si, 0.3 at % of Zn, and Sn) in Conventional Example, the Young's modulus was 131 GPa, which was high.

Contrary to this, in all Invention Examples 1 to 18, the Young's modulus was in a range of 115 GPa or less and was thus set to be low, resulting in excellent elasticity. In addition, the region having a CI value of 0.1 or less after the finish rolling process was in a range of 80% or less, and excellent bending formability can be ensured. Furthermore, the average grain size after the intermediate heat treatment process was in a range of 1 μm or greater and 100 μm or smaller, and proof stress was also increased. In addition, in Invention Examples 1, 2, 10, 11, 13, and 14, even after the finish rolling process, the average grain size was in a range of 1 μm or greater and 100 μm or smaller.

As described above, according to the Invention Examples, it was confirmed that a copper alloy for electronic devices which has low Young's modulus, high proof stress, high electrical conductivity, and excellent bending formability and is appropriate for a component for electronic devices such as a terminal including a connector, a relay, and a lead frame can be provided.

INDUSTRIAL APPLICABILITY

When a component for electronic devices having high proof stress and high bending formability is manufactured, a more appropriate copper alloy can be provided.

REFERENCE SIGNS LIST

S05: INTERMEDIATE HEAT TREATMENT PROCESS
S06: FINISH ROLLING PROCESS (FINISHING WORKING PROCESS)

The invention claimed is:

1. A copper alloy for electronic devices, consisting of:
a binary alloy of Cu and Mg,
wherein the binary alloy consists of Mg at a content of 3.3 at % or more and 6.9 at % or less, and a remainder of Cu and unavoidable impurities,
when a concentration of Mg is given as X at %, an electrical conductivity of the copper alloy (% IACS) satisfies $\sigma \leq \{1.7241/(-0.0347 \times X^2+0.6569 \times X+1.7)\} \times 100$,
an average grain size is in a range of 1 μm or greater and 100 μm or smaller,
the copper alloy is a Cu—Mg solid solution alloy supersaturated with Mg, and
a Young's modulus is in a range of 125 GPa or less, and a 0.2% proof stress $\sigma_{0.2}$ is in a range of 400 MPa or more.

2. The copper alloy for electronic devices according to claim 1,
wherein a ratio of a region having a CI value of 0.1 or less is in a range of 80% or less as a measurement result according to an SEM-EBSD method.

3. The copper alloy for electronic devices according to claim 1,
wherein an average number of intermetallic compounds having grain sizes of 0.1 μm or greater and mainly containing Cu and Mg is in a range of 1 piece/$\mu m^2$ or less during observation by a scanning electron microscope.

4. The copper alloy for electronic devices according to claim 1,
wherein an amount of Sn as an unavoidable impurity is in a range of less than 0.1 mass %, and an amount of Zn as an unavoidable impurity is in a range of less than 0.01 mass %.

5. A copper alloy for electronic devices, consisting of:
a binary alloy of Cu and Mg,
wherein the binary alloy consists of Mg at a content of 3.3 at % or more and 6.9 at % or less, and a remainder of Cu and unavoidable impurities,
when a concentration of Mg is given as X at %, an electrical conductivity of the copper alloy (% IACS) satisfies $\sigma \leq \{1.7241/(-0.0347 \times X^2+0.6569 \times X+1.7)\} \times 100$,
an average grain size of a copper material after an intermediate heat treatment and before finishing working is in a range of 1 μm or greater and 100 μm or smaller,
the copper alloy is a Cu—Mg solid solution alloy supersaturated with Mg, and
a Young's modulus is in a range of 125 GPa or less, and a 0.2% proof stress $\sigma_{0.2}$ is in a range of 400 MPa or more.

6. The copper alloy for electronic devices according to claim 5,
wherein a ratio of a region having a CI value of 0.1 or less is in a range of 80% or less as a measurement result according to an SEM-EBSD method.

7. The copper alloy for electronic devices according to claim 5,
wherein an average number of intermetallic compounds having grain sizes of 0.1 μm or greater and mainly containing Cu and Mg is in a range of 1 piece/$\mu m^2$ or less during observation by a scanning electron microscope.

8. The copper alloy for electronic devices according to claim 5,
wherein an amount of Sn as an unavoidable impurity is in a range of less than 0.1 mass %, and an amount of Zn as an unavoidable impurity is in a range of less than 0.01 mass %.

9. A copper alloy plastic working material for electronic devices, consisting of the copper alloy for electronic devices according to claim 1,
wherein a Young's modulus E is in a range of 125 GPa or less, and a 0.2% proof stress $\sigma_{0.2}$ is in a range of 400 MPa or more.

10. The copper alloy plastic working material for electronic devices according to claim 9,
wherein the copper alloy plastic working material is used as a copper material included in a component for electronic devices such as a terminal including a connector, a relay, and a lead frame.

11. A component for electronic devices, comprising the copper alloy for electronic devices according to claim 1.

12. A terminal comprising the copper alloy for electronic devices according to claim 1.

13. A copper alloy plastic working material for electronic devices, consisting of the copper alloy for electronic devices according to claim 5, wherein a Young's modulus E is in a range of 125 GPa or less, and a 0.2% proof stress $\sigma_{0.2}$ is in a range of 400 MPa or more.

14. The copper alloy plastic working material for electronic devices according to claim 13, wherein the copper alloy plastic working material is used as a copper material included in a component for electronic devices such as a terminal including a connector, a relay, and a lead frame.

15. A component for electronic devices, comprising the copper alloy for electronic devices according to claim 5.

16. A terminal comprising the copper alloy for electronic devices according to claim 5.

* * * * *